United States Patent [19]

Graf

[11] 4,039,281

[45] Aug. 2, 1977

[54] METHOD FOR THE PREPARATION OF LEATHER AND FUR SKINS

[75] Inventor: Hans Dieter Graf, Eurasburg, Germany

[73] Assignee: Dr. Th. Boehme KG., Chem. Fabrik, Geretsried, Germany

[21] Appl. No.: 705,630

[22] Filed: July 15, 1976

[30] Foreign Application Priority Data

| | | |
|---|---|---|
| July 19, 1975 | Germany | 2532391 |
| July 19, 1975 | Germany | 2532393 |
| Feb. 18, 1976 | Germany | 2606420 |

[51] Int. Cl.[2] ..... C14C 1/08; C14C 3/26

[52] U.S. Cl. ..... 8/94.14; 8/94.1 D; 8/94.19 R

[58] Field of Search ..... 8/94.1 D, 94.1 R, 94.14, 8/94.19 R

[56] References Cited

U.S. PATENT DOCUMENTS

| | | | |
|---|---|---|---|
| 2,523,326 | 9/1950 | Putnam | 8/94.33 |
| 2,781,241 | 2/1957 | Ushakoff | 8/94.18 |
| 3,006,714 | 10/1961 | Ushakoff | 8/94.18 |
| 3,512,918 | 5/1970 | Endres et al. | 8/94.24 |

OTHER PUBLICATIONS

Journal of The American Leather Chemist Assoc., Production of Leather Using Non-Aqueous Systems, pp. 314–332, June 1958.

Journal of The American Leather Chemist Assoc., Sole Leather Tanning in a Solvent System, pp. 204–209, Apr. 1955.

*Primary Examiner*—John Kight, III

*Attorney, Agent, or Firm*—Jerry Cohen; Charles Hieken

[57] ABSTRACT

Tanning and pickling of leather and fur skins are conducted at selected water content ranges (50–80 weight percent for leather, 30–80 for skin) established by partial water removal; in water-immiscible organic solvent media, preferrably halogenated hydrocarbons, to produce end products (after such further finishing steps as post-tanning, dyeing, fatliquoring and coating) which are equal to or better in quality than products tanned conventionally in aqueous media while avoiding the pollution or pollution-related economic problems of aqueous media.

11 Claims, No Drawings

METHOD FOR THE PREPARATION OF LEATHER AND FUR SKINS

BACKGROUND OF THE INVENTION

The invention concerns a method for the preparation of leather and fur skins. In the prior art, raw hides or raw skins are soaked in a medium containing water as the primary component and are conventionally prepared for pickling and subjected to other beamhouse (wet) operations such as cleaning and liming. Next, the hides or skins are partially freed of the water contained therein or adhering thereto by centrifuging, squeezing out, or draining. Then they are placed in a liquid medium in a pit or drum where they are subjected to the reaction with pickling chemicals and tanning chemicals and if necessary are treated with a lubricant. Then, in the case of leather preparation, the thus tanned leather is subjected to post-treatment or post-tanning in the liquid medium by the reaction of neutralization chemicals, if need be tanning chemicals, or fatliquor. In the practical application of this known process, aqueous media have been used exclusively up to now for the preparation of leather. The same is true also for the preparation of fur hides (see for example, Fritz Stather, *Gerberei-Chemie und Gerberei-Technologie* [Tanning Chemistry and Tanning Technology], 4th Ed., page 340, and Hubert Riskes, *Die Pelzwirtschaft* [The Fur Business], No. 4, 1974, page 42 ff).

Originally aqueous media were used which contained the chemicals and agents necessary for carrying out the individual processing steps in only small concentrations, preferentially in the form of weak solutions. A disadvantage of the known method is the extensive pollution of the environment caused by the discharge of the aqueous media which still contains chemicals used for treatment as well as by the waste water used for intermediate rinsing processes. There are special problems when waste waters containing chromium are present; such are employed in tanning or finishing high-temperature-resistant leather or fur skins. Since these waste waters are produced in large quantities, a high economically unjustified expenditure is required to convert them to a problem-free dischargeable form. There is also the disadvantage (in the known process) that a considerable amount of chemicals in the production process do not react, but are discharged with the waste waters.

Recently attempts have been made to reduce the quantities of waste waters to be discharged by increasing the concentration of the chemicals used in the aqueous media and by eliminating rinsing processes between the individual processing steps. New tanning chemicals as well as new equipment have been used for this purpose, for exmple, the Coretan machine, the Hagspiel machine, or devices of a cement-mixer type used for the tanning of leather, and cement-mixer type devices or drums, for example, for the preparation of fur skins. While the waste water problem and the loss of chemicals can be improved somewhat through such measures, there remains, however, a large clearly technical expenditure that must be made in order to be able to discharge the waste waters particularly conditioned by tanning in a composition which does not endanger the environment. In many countries maximum permissible chemical quantities which can be discharged have been established by law.

Fatliquoring, degreasing, and dyeing of leather and fur skins have already been conducted in organic solvents. It has also been proposed (see Stather, *Gerberei-Chemie und Gerberie-Technologie,* 4th Ed., page 319, and H. Weber, *Das Leder* [*Leather*], 1969 Annual, p. 8ff) that tanning be conducted with solutions of water-soluble (miscible with water) alcohols and ketones, for example, acetone. Since hides and skins are hydrophilic and contain water, experts have earlier been prejudiced to limiting such media to the use of organic solvents that are miscible with water. It was thought that only in this way could the solvents and the chemicals dissolved in them penetrate the material to be tanned. But such tanning process could not be carried out in practice because of the fire hazard of solvents which are water-miscible and also because of the high costs required for solvent recovery.

It is an important object of the present invention to prepare leather and fur skins in a way which permits a great reduction of harmful waste waters or waste waters difficult to convert to harmless form.

It is a further object of the invention to considerably economize on the cost of chemicals, thus leading to a shortening of processing time consistent with the preceding object.

The invention is to be incorporated in and conducted economically in conventional processes thereby saving equipment costs consistent with one or more of the preceding objects.

It is a further object of the invention to reduce energy costs in the drying process, and to create at least a partial savings in the milling process for skin preparation consistent with one or more of the preceding objects.

SUMMARY OF THE INVENTION

In searching for a solution to this problem, it was found that by surmounting the general prejudice of experts, it is possible to conduct tanning, and also pickling operations, in liquid media which consist of organic solvents that are not miscible with water. It was further found in particular that such solvents that are not miscible with water, and are noninflammable (e.g., trichloroethylene or tetrachloro-ethylene) can be used, and further that special advantages can be obtained, if the solvents and the necessary chemicals for the pickling and tanning are selected such that the chemicals are not soluble in the solvent. According to the present invention, therefore, hides or pre-tanned leather with a water content of 50–80 weight percent or skins with a water content of 30–80 weight percent are subjected to reaction with chemicals for tanning and/or post-tanning in an organic solvent that is not miscible with water. It is further preferred and distinctly advantageous, according to the invention, that hides or pretanned leather with a water content of 50–80 weight percent or skins with a water content of 30–80 weight percent are subjected to reaction with pickling chemicals in an organic solvent that is not miscible with water. Within the scope of the invention, pre-tanned leather and tanned skins with the above respective water contents may be reacted with neutralization chemicals in the water-immiscible, organic solvent. Also post-tanning fatliquoring and dyeing may be carried out in the solvent medium used according to the invention.

According to the invention, the hides or pre-tanned leather or skins are subjected to the pickling chemicals and tanning chemicals without changing the solvent. Liquid halogented hydrocarbons, and preferably hydrocarbon chlorides or hydrocarbon fluoro-chlorides are particularly suitable as the solvent. In particular, water-insoluble solvents, such as for example, trichloroethylene and tetrachloroethylene, as have been used previously for dry cleaning and for degreasing the leather and fur materials can be used. Solute chemicals for pickling and tanning, such as those already used in conventional methods for the preparation of leather and fur skins can also be used. The same is true also for the neutralizing chemicals. In pickling and tanning processes carried out according to the invention, and also for subsequent process steps, especially post-tanning and fatliquoring and dyeing, apparatus arrangements similar to those known previously for solvent degreasing of fur and leather is preferably used.

According to the invention, at least the tanning chemicals (but also the other necessary chemicals, are not first dissolved in water, but are directly added to the solvent. On the other hand it is also possible to add the chemicals used suspended (dispersed) in an organic solvent to the solvent used in the process. The advantages of the invention are in principle retained, if the chemicals which have been pre-dissolved in water are added to the solvent, as long as the water quantities used for the predissolving of all the chemicals going into the solvent is measured such that the total water quantity in the process amounts to a maximum 400 weight percent with respect to the dry hide material.

According to a further novel aspect of the method according to the invention, chemicals are used at least for tanning or post-tanning, which are insoluble in the organic solvent which in turn is non-miscible with water. In principle, pickling and tanning can be carried out with pickling and tanning chemicals that are soluble in the solvent used here; however, in this case, the advantages of using up all the chemicals and significant shortening of the process are lost. Since the solvent used in the process according to the invention, especially in tanning, is not discharged to the outside, but rather remains in the process (after tanning has ended it is pumped into a storage tank or into a distillation vessel), and discharge of tanning waste waters into the environment is avoided. The solvent also contains only minimum amounts of water and tanning chemicals after the tanning process has ended; there is no chromium tanning salt residue. The chemicals applied are therefore completely utilized and the solvent can be prepared for re-use without additional cost or with only a small expenditure. Only when chemicals are used which are soluble in the solvent, do chemical residues remain; however, these residues are not discharged into the environment.

It is also possible to obtain fur skins which are stable to boiling water by suitably carrying out the method according to the invention. With an appropriate application, the hair is absolutely clean, free of chromium and unmatted. The leathers and furs cannot be distinguished either in appearance or in touch from leathers classically tanned or from classically tanned fur materials.

DETAILED DESCRIPTION OF PREFERRED EMBODIMENTS

The following illustrative, non-limiting examples show preferred embodiments of practice of the invention. All weight data in per cent refer to the centrifuged weight of the hide or skin material, unless stated otherwise.

EXAMPLE 1

Finishing of Sheepskin

A. Removal of fat from the skin and equalizing its water content

The sheepskins are soaked in water, washed as needed and centrifuged to a water content of roughly 55 percent in a solvent de-fatting machine, such as those found in dry cleaning and in the fur industry. The skins are then treated for 10 minutes with cold trichloro-ethylene in a ratio of 1 kg of skin to 3 liters of trichloro-ethylene. Subsequently the trichloro-ethylene is pumped into a tank or into a distillation vessel and the skins are centrifuged for a short time.

B. Pickling

The thus pre-treated skins are treated in a ratio of 1 kg of skin to 7 liters of trichloro-ethylene together with 2.3 percent salt (added undissolved) in the same machine for 20 minutes. The number of revolutions of the drum is adjusted for the total tanning and pickling process according to the type of skin. Pickling itself is carried out for 60 minutes with 1.1 percent of 85 percent formic acid, which is added undiluted.

C. Tanning

Without changing the solvent, 3.1 percent of a 4/12 basic chromium tanning material containing 26 percent chromic oxide (for example, "Chromosal B" manufactured by Farbenfabriken Bayer AG, Leverkusen, Federal Republic of Germany) is added undissolved. The reaction time is 1 hour. After 15 minutes, the solvent is free of chromium tanning material, which has been dissolved in the residual water of the hide. The hair remains absolutely clean. 2.8 percent of a synthetic tanning material (for example, "Tannit AK" manufactured by the company Dr. Th. Boehme KG Chem. Fabrik, Geretsried, Federal Republic of Germany) is then added and the skin is treated for another 30 minutes. After this time, the solvent, which contains minimum amounts of water as well as traces of tanning and pickling chemicals, but no chromium, is pumped either to a separate tank for re-use or to a distillation vessel. Subsequent centrifuging is carried out for a period of 3 minutes.

D. Evaporation of the Solvent and fatliquoring

The solvent (trichloro-ethylene) is evaporated for 20 minutes in the same machine at a temperature of 70° C. The skins are subsequently removed from the machine and fat-liquored in the usual way in a ratio of 1:15 (with respect to the centrifuging weight) with 10 g/liter of a synthetic anionic fatliquor (for example, "Eskatan CS" of the company previously mentioned, Dr. Th. Boehme KG) at 45° C for 1 hour. Further treatment (drying, staking, and ironing) is carried out in the usual way.

The resulting skins have shrinkage temperature of 100° C (are stable to boiling water) and correspond to conventionally finished fur skins vis-a-vis leather quality, but are characterized by a completely chromium-free hair.

EXAMPLE 2

Tanning of German Red Fox (White Tanning)

A. Removal of fat from the skin and equalizing its water content

The soaked, washed, and centrifuged skin is treated according to Paragraph (A) of Example 1.

B. Pickling

Trichloro-ethylene in a ratio of 1 kg of centrifuged skin to 6.5 liters of trichloro-ethylene and 2.5 percent salt is added to the centrifuged material. After 20 minutes 1.1 percent of 85 percent formic acid and 1.1 percent of 57 percent glycolic acid is added. According to the equipment construction, the operation can be carried out either at a low rpm (for a 50-kg machine, roughly at 10 rpm) or it can be carried out at a high drum revolution rate (for a 50-kg machine, roughly 24 rpm), but at present, only if pauses are made.

C. Tanning

Without changing the solvent, 5.6 percent of potash alum are added; the drum is agitated, as in pickling, for 1 hour. Subsequently an addition of 2.6 percent of a liquid, synthetic tanning material (especially "Tannit AK;" see Example 1 ) is made with a subsequent 30-minute agitation.

D. Neutralization

Without changing the solvent, 2.5 percent sodium hydrogen carbonate is added and the drum is agitated for 15 minutes without interruption. The solvent, which contains minimum amounts of water and tanning pickling chemicals is pumped to a tank for re-use or into the distillation vessel. Centrifuging of the skin is carried for three minutes.

E. Evaporation of the Solvent and Fatliquoring

The evaporation of the solvent is carried out at 40°–50° C for 25 minutes in the machine. Then the machine is emptied and the skins are given a conventional brush fatliquoring with 300 g/liter of a synthetic anionic fatliquor (for example "Eskatan CS;" see Example 1). The rest of the operation is carried out in conventional manner.

The thus-treated skins display a shrinkage temperature of approximately 80° C, i.e., a clearly better complete tanning of the fur leather is obtained by using a smaller amount of tanning chemicals than in treatment in an aqueous medium. The quality of the fur skin corresponds to that of a conventionally tanned skin.

EXAMPLE 3

Finishing of Lambskins

Fifty kg of soaked, washed, centrifuged lambskin with flesh removed and with a water content of roughly 50 per cent is treated for five minutes in a machine of the type described in Example 1 with 400 liters of a solvent, comprised of tetrachloro-ethylene, which contains 50 g/liter of triolein (glycerol trioleate). Subsequently 900 g of 85 percent formic acid dissolved 1:1 in water are added by means of an automatic proportioning device. After a further treatment time of 5 minutes, 600 g of a 4/12 basic chromium tanning material containing 26 percent chromic oxide, which has been dissolved in 1.5 liters of water by boiling, is automatically proportioned. The treatment time is 40 minutes. After this time, 1250 g of a liquid 50 percent anionic synthetic tanning material is automatically proportioned. Standing time is 60 minutes. Next the solvent is pumped into a tank or the distillation vessel. The skin is centrifuged for a short time, then the residue of the solvent is removed by evaporation in the machine at 70° C, and the skin is then dried in the drying drum. The skins can be further treated in the usual way, whereby an additional fatliquoring in an aqueous medium or a brush fatliquoring can be carried out depending on the intended application of the finished skins. The resultant skins have a shrinkage temperature of from 95° C to a temperature at which they are stable to boiling water and correspond in leather quality to conventionally finished fur skins. The hair is practically free of chromium.

EXAMPLE 4

Tanning of Muskrat (White Tanning)

Fifty kg of a soaked, washed, and centrifuged muskrat skin with flesh removed and with a water content of approximately 60 percent are rotated in a machine of the type described in Example 1 with 400 liters of a solvent consisting of trichloro-ethylene, for 5 minutes with heating to 35° C. Subsequently 1.4 percent of 85 percent formic acid and 1.0 percent of 57 percent glycolic acid are added and the skins are left to stand for 20 minutes. Then 4.8 percent of potash alum (powder) is added, the skins are treated for 20 minutes and subsequently 2.8 percent of a synthetic tanning material (for example, Tannit AK, see Example 1) is added and the skins are left to stand for 20 minutes. Neutralizing is carried out with 2.8 percent sodium bicarbonate and a subsequent standing time of 20 minutes. Then the solvent, which still contains minimum amounts of water and tanning and pickling chemicals is pumped for re-use to a tank. The skins are centrifuged for three minutes and subsequently the solvent is removed within 20 minutes upon heating the air to 40°–50° C. Then the skins with leather wet with water are removed from the machine and a conventional brush fatliquoring is carried out either directly or after an intermediate drying in a drum drier, employing 300 g/liter of a synthetic, anionic fatliquor (for example, "Eskatan GLS" of the company, Dr. Th. Boehme KG). The finishing processes of the skins (refining, de-fatting, milling) are carried out as usual. The thus processed skins display a shrinkage temperature of approximately 80° C and, despite the smaller amounts of pickling and tanning chemicals employed, are better tanned than the skins tanned according to the conventional aqueous method.

EXAMPLE 5

Chromium Post-Tanning of White-Tanned Marmot Skins

Fifty kg of white-tanned marmot skins are soaked again with a bath ratio of 1:30 (1 kg of skin: 30 liters of water) with 2.5 g/liter of a softening agent (for example, "Artesan L 691" of the company Dr. Th. Boehme KG), 50 g/liter of salt, and 20 g/liter of a fatliquor) (for example Eskatan GLS of the company Dr. Th. Boehme KG) at 40° C for a period of 1–3 hours. Subsequently, the skins are centrifuged to a water content of 40–50 percent and are placed in a machine of the type described in Example 1 or another suitable apparatus with the addition of 800 liters of a solvent consisting of tetrachloro-ethylene; they are then heated to 30° C for a period of 10 minutes. Subsequently 1.25 kg of 85 percent formic acid, dissolved in 1.7 liters of water are added and the skins are left to stand for 5 minutes. Then 2.9 kg of a 4/12 basic chromium tanning substance containing 26 percent of chromic oxide (for example, "Chromosal B" of Farbenfabriken Bayer) is added and treatment is carried out for 50 minutes. Next, the solvent is pumped out into a storage tank for re-use, the skins are centrifuged for a short time, and then mixed with 400 liters of a similar type, but fresh solvent. After a standing time of two minutes, 2.4 kg of an anionic softener (for example, "Cutapol OF" of the company Dr. Th. Boehme KG) mixed with 2 liters of water is added and treatment is carried out for 10 minutes. Then the solvent is pumped into a second tank or into the distillation vessel, the skins are centrifuged for three minutes, and then the residually adhering solvent is removed by heating the air to 70° C for 20 minutes. The skins removed from the machines are dyed directly or after an intermediate drying with the addition of 5 g/liter of an anionic fat liquor and dried as usual. The finished skins display a shrinkage temperature of 100° C and cannot be distinguished from classically chromium-post-tanned skins despite the smaller amount of chemicals in the leather. The hair is not only free of chromium, but it is cleaner, not stuck together, and more uniform.

EXAMPLE 6

Processing of Sheepskin for Clothing

All percent data refer to pickling weight. Pickled sheepskins are washed in an 8 percent salt solution for 30–60 minutes and are subsequently centrifuged to a water content of approximately 60 percent or are squeezed out and placed in a machine of the type described in Example 1, which is loaded with a solvent consisting of tetrachloro-ethylene in a ratio of 1 kg of pelts to 10 liters of solvent. To the solvent was added — previous to the fat liquoring of the pelts — 50 g/liter of a chloro-paraffin containing 40 percent chlorine and 10 g/liter of a low ethoxylated fatty alcohol (roughly 2–5 moles of ethylene oxide per mole of a fatty alcohol). The pelts are now agitated for 10 minutes upon heating the solvent to 35° C. Subsequently, one adds 2 percent of a synthetic tanning substance (for example, Tannit AK; see Example 1) dispersed in 5 percent trichloroethylene and lets them stand for another 20 minutes. Next 5 percent of a 4/12 basic chromium tanning substance containing 26 percent chromic oxide (for example Chromosal B of Farbenfabriken Bayer) dissolved in 10 percent water is added and they are agitated for 30 minutes. Then neutralizing is carried out with 2 percent of a buffer salt added in powder form (for example, "Neutrigan" of the company Badische Anilin- und Sodafabrik, Ludwigshafen) and the skins are left to stand for 10 minutes. The subsequent post-tanning is carried out for 20 minutes with 10 percent of a synthetic tanning substance (for example, Tannit AK of the company Dr. Th. Boehme KG) which has been shaken up with 10 percent perchloro-ethylene before being added. The solvent is discharged into the operation tank and can be used again. The leather is now centrifuged for a short time and the solvent is removed within 10 minutes by drying in the machine at 70° C. The leather, which is still wet with water (water content roughly 50 percent) is dried immediately as usual and subsequently dyed and fat-liquored as usual. If too high a quantity of natural fat should remain in the leather after intermediate drying, it can be re-defatted in the solvent with not further treatment. The resulting leathers are stable to boiling water, uniform in color, and are distinguished by good body and a good compact grain.

EXAMPLE 7

Processing of Goatskin for Clothing

All percent data refer to pelt weight. Raw dried goatskins are soaked, softened, limed, delimed, bated, and subsequently squeezed out according to the classical method so as to reduce the water content to roughly 60–70 percent. Subsequently the pelts are placed in a machine described in Example 1, which is loaded with a solvent consisting of trichloro-ethylene in a ratio of 1 kg of pelts to 10 liters of solvent. Three percent of 85 percent formic acid dissolved in 3 percent water is added and the skins are allowed to stand for 10 minutes. Then 5 percent of a 4/12 basic chromium salt (for example Chromosal B of Farbenfabriken Bayer) is added undissolved and the skins are left to stand for 30 minutes. Then an addition of 2.5 percent of a buffer salt, undissolved, is added for neutralization (for example, Neutrigan of the company BASF) and the skins are left to stand for 10 minutes; then 8 percent of a synthetic anionic tanning substance (for example, Tannit 560 of the company Dr. Th. Boehme KG) is added, the skins being left to stand for 20 minutes. Next the solvent is pumped into the storage tank for purposes of re-use and the leather is centrifuged for 1 minute. Then the same type, but fresh solvent is added in a ratio of 1 kg of pelts to 6 liters of solvent, as well as 5 percent of an emulsifier fatliquor (for example, Cutapol OF of the company Dr. Th. Boehme KG), mixed with 3 percent water and 5 percent chloro-paraffin. They are left to stand for 15 minutes upon heating to 50° C. The bath is then pumped to another tank for later re-use. The leather is centrifuged for three minutes and freed of solvent within 10 minutes in the machine at 70° C. The leather now wet with water is intermediately dried and further processed as usual (dyeing, fatliquoring, drying). The resulting leathers are characterized by a special uniformity, good body, and a very find, compact grain.

a. The invention can also be practiced with all kinds of natural and synthetic tanning material including vegetable tanning agents, tannic acids, alum tanning agents, aldehyde tanning agents, quinone tanning agents, as well as the chromium oxide referred to above b. The possible organic solvents usable as the main solvent medium, in addition to or in lieu of trichloroethylene or tetrachloroethylene, may include (single or in mixtures):

turpentine;
xylene;
tributyl phosphate;
toluene;
tetrachloroethane;
methyl isobutyl;
ketone;
benzene;
acetates;
hexanes and hexanones
ethers;
sulfoxides;
carbon tetrachloride;
chloroform In each such case, the tanning chemical is preferably selected to be insoluble in the particular solvent.

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims.

The chemicals from the production of the Dr. Th. Bohme KG mentioned by use of their trade names in the description of this patent (application) show the following chemical structure:

Tannit AK solution of a phenolsulfonicacid condensate mixed with cationic resins.
content: tanning agent: 32 - 35%; other solids: 12–14%

Tannit 560 solution of a phenolsulfonicacid condensate
content: tanning agents: 37–40%; other solids: 13 - 15%

Eskatan CS mixture of modified alcanolesters of sulfuric acid, sodium salts of alcansulfonicacid, spermoil and long chain hydrocarbons
content: 70%

Eskatan GLS mixture of sulfuricacidester of modified fattyalcols with long chain hydrocarbons
content: 60%

Cutapol OF mixture of phosphoric acidester with long chain esters of polyglycols content: 70%

Atesan L 691 mixture of alcansulfonic acid with fungicidal and bactericidal acting phenolic compounds
contents: 25%

What is claimed is:

1. Method for the preparation of leather and fur skins comprising adjusting water content to 50–80 weight percent for leather or 30–80 weight percent for skins and subject them to reaction with chemicals for tanning in a water immiscible organic solvent.

2. Method according to claim 1 and further comprising, reaction of the leather or skins with pickling chemicals in a water-immiscible organic solvent.

3. Method according to claim 1 and further comprising, subjecting the product to reaction with neutralization chemicals in an organic solvent that is not miscible with water.

4. Method according to claim 1 wherein pickling and tanning are carried out in sequence in a common solvent.

5. Method according to claim 1 wherein the tanning chemicals are added directly to the water-immiscible, organic solvent.

6. Method according to claim 1 wherein the tanning chemicals are suspended in preliminary organic solvent and thereafter added to the main organic solvent.

7. Method according to claim 1 wherein the tanning chemicals are predissolved in water and added to the solvent medium, the water quantities used for pre-dissolving all the chemicals being controlled such that the total water quantity amounts to a maximum 400 weight percent with respect to the dried material to be tanned.

8. Method according to claim 1 wherein tanning chemicals are used which are not soluble in the said organic solvent.

9. Method according to claim 1 wherein the solvent is a halogenated hydrocarbon.

10. Method according to claim 1 wherein leather with a water content of 60–70 weight percent is treated.

11. Method according to claim 1 wherein skins with a water content of 40–70 weight percent are treated.

* * * * *